US012017320B2

(12) United States Patent
Marty

(10) Patent No.: US 12,017,320 B2
(45) Date of Patent: Jun. 25, 2024

(54) METHOD AND GRINDING MACHINE FOR FABRICATING A WORKPIECE COMPRISING A HELICAL GROOVE

(71) Applicant: ROLLOMATIC SA, Le Landeron (CH)

(72) Inventor: Jean-Charles Marty, La Neuveville (CH)

(73) Assignee: Rollomatic SA, Le Landerson (CH)

( * ) Notice: Subject to any disclaimer, the term of this patent is extended or adjusted under 35 U.S.C. 154(b) by 971 days.

(21) Appl. No.: 16/971,611

(22) PCT Filed: Mar. 27, 2019

(86) PCT No.: PCT/IB2019/052502
§ 371 (c)(1),
(2) Date: Aug. 20, 2020

(87) PCT Pub. No.: WO2019/197931
PCT Pub. Date: Oct. 17, 2019

(65) Prior Publication Data

US 2021/0122002 A1 Apr. 29, 2021

(30) Foreign Application Priority Data

Apr. 9, 2018 (CH) ..... CH00452/18

(51) Int. Cl.
*B24B 19/04* (2006.01)
*B24B 49/05* (2006.01)

(52) U.S. Cl.
CPC ..... *B24B 19/04* (2013.01); *B24B 49/05* (2013.01)

(58) Field of Classification Search
None
See application file for complete search history.

(56) References Cited

U.S. PATENT DOCUMENTS 4,015,372 A 4/1977 Fukuma
4,930,265 A 6/1990 Belthle
(Continued)

FOREIGN PATENT DOCUMENTS

CA 2264106 A1 3/1998
CN 1207334 A 2/1999
(Continued)

OTHER PUBLICATIONS

International Search Report and Written Opinion for PCT/IB2019/052502 dated Jul. 11, 2019, 17 pages.

*Primary Examiner* — Hwei-Siu C Payer
(74) *Attorney, Agent, or Firm* — Blank Rome LLP

(57) ABSTRACT

The invention concerns a method and a grinding machine (4) for machining a workpiece (1) comprising a desired helical groove. The method comprises a step of grinding a calibration groove (12) on the surface (10) of the workpiece according to a predetermined helix pattern of the desired helical groove and by means of an abrasive wheel (2) of the grinding machine. The calibration groove (12) has a calibration length that is equal or smaller than the predetermined length of the desired helical groove and has a calibration depth (120) that is smaller than the predetermined depth of the desired helical groove. The method comprises steps of: determine an abrasive wheel dimension (22, 23, 24, 25) of the abrasive wheel (2) by measuring the calibration depth; and using the determined wheel dimension (22, 23, 24, 25) for grinding the desired helical groove by means of the abrasive wheel (2).

14 Claims, 2 Drawing Sheets

(56) References Cited

U.S. PATENT DOCUMENTS

| | | | | |
|---|---|---|---|---|
| 7,103,441 | B2 | 9/2006 | Engelfried et al. | |
| 2006/0240744 | A1 | 10/2006 | Campisi et al. | |
| 2021/0122002 | A1 * | 4/2021 | Marty | B24B 49/05 |

FOREIGN PATENT DOCUMENTS

| | | | |
|---|---|---|---|
| CN | 1836841 | | 9/2006 |
| CN | 101898316 | | 12/2010 |
| CN | 101898316 | B | 8/2013 |
| CN | 103358208 | | 10/2013 |
| CN | 103370168 | A | 10/2013 |
| CN | 107750197 | | 3/2018 |
| DE | 9301269 | U1 | 5/1993 |
| GB | 1171809 | A | 11/1969 |
| JP | H0723082 | | 1/1995 |
| JP | 2590531 | B2 | 3/1997 |
| JP | H11347930 | A | 12/1999 |
| JP | 2002504440 | | 2/2002 |
| JP | 2010042484 | | 2/2010 |
| JP | 2010194623 | A | 9/2010 |
| KR | 20070024662 | | 3/2007 |
| KR | 20070100933 | | 10/2007 |
| KR | 20130112002 | | 10/2013 |
| TW | 577786 | B | 3/2004 |
| TW | 201545833 | A | 12/2015 |
| WO | WO-99/43469 | A1 | 9/1999 |
| WO | WO 2004069471 | A2 * | 8/2004 |

* cited by examiner

METHOD AND GRINDING MACHINE FOR FABRICATING A WORKPIECE COMPRISING A HELICAL GROOVE

RELATED APPLICATIONS

This application is a national phase of PCT/IB2019/052502, filed on Mar. 27, 2019 which claims the benefit of Swiss Application No. CH00452/18, filed on Apr. 9, 2018. The entire contents of these applications are hereby incorporated by reference.

FIELD OF THE INVENTION

The present invention concerns a method for manufacturing a workpiece, in particular the first of a series of identical workpieces, and a grinding machine for implementing the method.

DESCRIPTION OF RELATED ART

There is a need for reliable and cost-effective manufacturing of series of identical elongated workpieces by machining cylindrical materials, notably cylindrical-shaped monoblocs (i.e. single blocks) of metal or of ceramic, cylindrical-shaped composite materials, or cylindrical-shaped aggregation of distinct materials (e.g. by soldering or brazing). Most of these elongated workpieces are tools comprising one or more helical grooves (e.g. spirals or flutes), such as milling and drilling tools, e.g. drills (also called drill bits), end mills and any kind of rotary cutters.

Workpieces with one or more helical grooves are generally machined by means of a grinding machine comprising means for retaining the workpiece to be machined, a rotating abrasive wheel and means for providing a relative positioning between thee grinding wheel and the workpiece so as to machine a peripheral portion thereof.

The manufacturing of the first workpiece of the series as well as a repetitive manufacturing of elongated workpieces by means of the same grinding machine can lead to a workpiece having anomalies, e.g. variations up to defect, in dimensions with respect to the desired shape. This is generally due non-modelled mechanical tolerances between components of the grinding machine, an unprecise measuring and positioning system of the grinding machine as well as due to use and wear of the grinding wheel.

Some prior arts machining addresses this problem by continuously monitoring the workpiece during the manufacturing (e.g. on-process measurement).

Document U.S. Pat. No. 4,930,265 discloses a machining of a workpiece comprising a thread by means of a grinding wheel providing diameter reduction and forming of the thread. The machined diameter of the workpiece is monitored by a measuring head so as to change the position of the grinding wheel with respect to the rotating workpiece if the diameter of the ground portion of the peripheral surface deviates from a preselected value.

Some prior arts machining addresses the same problem by an initial calibration process, generally followed by corresponding re-calibration processes, wherein a reference piece is machined along different directions so as to calibrate the machine-internal measuring system.

Document U.S. Pat. No. 7,103,441 discloses a calibration process wherein a reference piece is fastened to a working spindle or a workpiece carrier of the grinding machine. The calibration grinding comprises, for each coordinate of the machine to be calibrated, grinding at least two test sections on the surface of the reference piece from different coordinate directions so as to determine positioning errors along this coordinate.

Document US20060240744 discloses a calibration method for correcting dimensions of the grinding wheel. The calibration method comprises a grinding at least two flanks and a top surface of a test piece so as to produce a calibrating blade, measuring the dimensions of the calibrating blade, and calibrating the grinding machine with the aid of the measurement result.

BRIEF SUMMARY OF THE INVENTION

The aim of the invention is to provide a more reliable and cost-effective manufacturing of elongated workpieces, each workpieces having a desired helical groove.

The solution provides a method and a grinding machine for fabricating one workpiece, notably of a series of identical workpieces, wherein the grinding of the desired helical groove on a surface of this workpiece permits to calibrate the grinding machine for machining the same workpiece as well as others workpieces of the series. As the workpiece is identical (e.g. within given tolerances) as the other of the series, there are no waste of row material.

The solution also reduces the time required for calibrating the machine as the calibration procedure is integral part of the machining of one workpiece.

Moreover, the solution provides a more accurate calibration of the grinding machine. In fact, the abrasive wheel dimension is determined under the same grinding conditions for grinding the desired helical groove. This permits to take into consideration not only the current dimension of the wheel but also position-dependent inaccuracies generated by components of the grinding machine.

In one embodiment, the dimension of the abrasive wheel is the diameter or the radius thereof. This solution permits to determine and/or regularly update this dimension of the abrasive wheel that is subjected to variations notably due to use (e.g. wear).

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

There is a need for reliable and cost-effective manufacturing of series of identical elongated workpieces by machining (raw or semi-finished) cylindrical materials. In particular, there is a need for reliable and cost-effective manufacturing of milling and/or drilling tools such as drills, end mills and any type of rotating cutters.

These tools are elongated workpieces comprising at least a helical groove (also called flute or cutting groove). The helical groove can comprises one or more complete turns around the longitudinal axis of the workpiece, typically in case of drills, or even less than a complete turn (i.e. a fraction or a portion of a complete turn), such as in some end mills and rotating cutters.

Workpieces with one or more helical grooves are generally machined by means of a grinding machine comprising means for retaining the workpiece to be machined (i.e. the cylindrical material to be machined), a rotating abrasive wheel (i.e. a round sharpening stone, also called grinding wheel or grindstone) and means for relatively positioning the grinding wheel with respect to the surface of the workpiece so as to machine a peripheral portion thereof.

A repetitive manufacturing of identical elongated workpieces can be advantageously realized by means of CNC grinding machine, i.e. grinding machine provided with computer numerical control (i.e. a processor-based controller), capable to executing pre-programmed sequences of machine control command. Sequences of machine control command can be notably pre-programmed by means of a software comprising a set of instructions readable by the computer numerical control (i.e. by the processor thereof). The grinding operation can thus be pre-programmed so as to machine each workpiece according to a given numerical model of the desired workpiece.

Figure 2A:
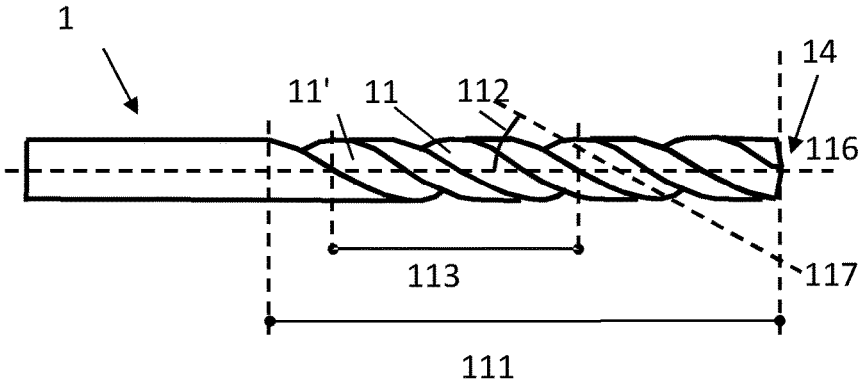
FIGS. 2*a-b* show a longitudinal and a cross-section view of an exemplary workpiece having a pair of helical grooves.

FIG. 2*a,b* show an exemplary workpiece having a first and a second desired helical groove 11,11' (e.g. flutes 11, 11').

The desired helical groove 11 is characterized by a predetermined length 111, a predetermined depth 110 and a predetermined helix pattern 112, 113, 114.

The predetermined length 111 can be:

- an axial distance (i.e. the distance along the longitudinal axis 116 of the workpiece) between the opposite extremities of the groove, or
- an axial distance of the farther point of the groove from the free tip 14 of the workpiece (i.e. the tip of the workpiece not retained by the grinding machine).

The predetermined depth 110 can be the deepest surface of the helical grove according to a spatial orientation 118 (thereafter measuring orientation). The measuring orientation 118 can be any line of the same imaginary plane comprising the longitudinal axis 116 of the workpiece, the line crossing the longitudinal axis 116 of the workpiece 1.

The helix pattern describes geometric features of the helical groove and can comprise the following parameters:

- a helix angle 112, i.e. the angle between the orientation line 117 (thereafter helix orientation) of each helix of the helical groove and the longitudinal axis 116 of the workpiece; and/or
- a lead angle 113 (also called pitch), i.e. the axial advance of the helical groove during one complete turn (i.e. 360°) of the workpiece around his longitudinal axis 116; and/or;
- a cross sectional template 114, i.e. the shape of the groove projected on a plane being perpendicular to the longitudinal axis 116 of the workpiece; and/or
- number of turns of the helical groove, or
- a fraction of a complete turn or a relative angle formed by the opposite and farthest ends of helical groove with respect to the longitudinal axis 116 of the workpiece, e.g. by projecting these ends on a plane being perpendicular to the longitudinal axis 116 of the workpiece.

Depending on the predetermined depth 110 and/or on the helix pattern, the desired helical groove can thus comprise either at least a complete turn around the longitudinal axis 116 of the workpiece, or less than a complete turn (i.e. a fraction or a portion of a complete turn).

Figure 1:
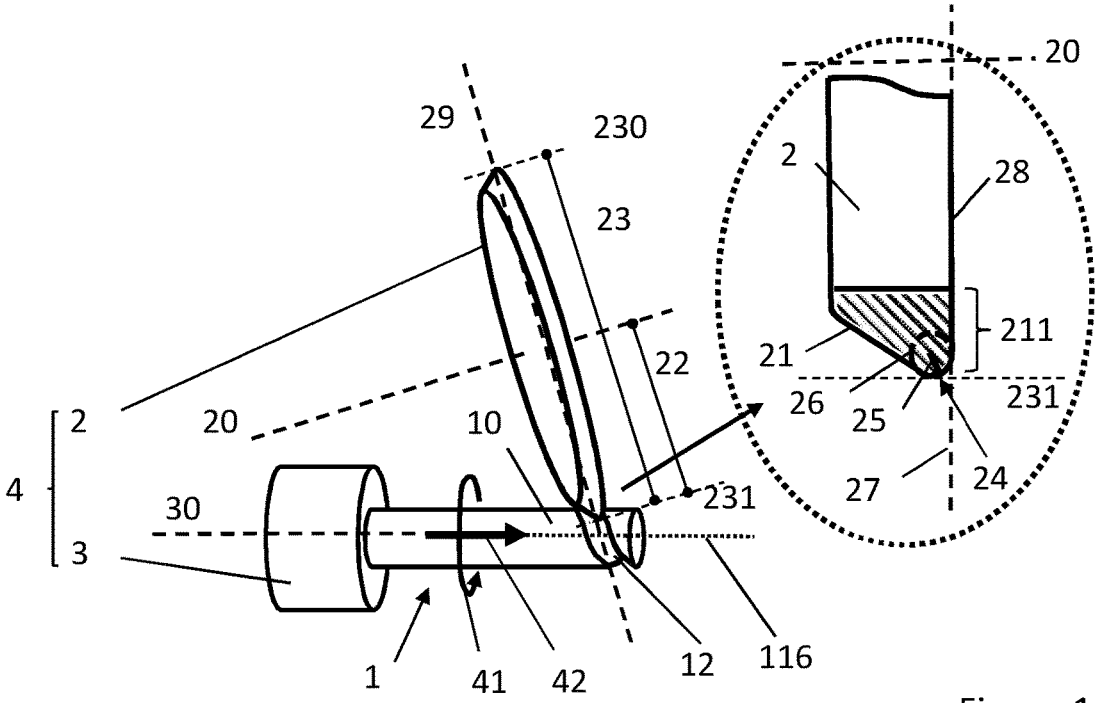
FIG. 1 shows a view of a grinding of a workpiece by means of a rotating abrasive wheel of a grinding machine, wherein some details of the abrasive wheel are highlighted.

As illustrated in FIG. 1, a desired helical groove can thus be efficiently machined on the workpiece 1 by:

- positioning the rotating abrasive wheel 2 of the grinding machine 4 along an axis 29 (thereafter grinding translation axis) being inclined up to perpendicular to the longitudinal axis 116 of the workpiece; while
- providing a translation and a rotating movement between the abrasive wheel and the workpiece along a rotational axis 30 (thereafter grinding rotational axis), this according to the predetermined length 111, the predetermined depth 110 and the predetermined helix pattern 112, 113, 114 of the desired helical groove.

Advantageously, the grinding rotational axis substantially coincides with the longitudinal axis 116 of workpiece, i.e. the symmetry axis of the (non-machined) cylindrical material.

However, the automatically machining based on the given model can lead to workpieces having anomalies, e.g. (tolerated on in-tolerance) variations up to defects, in dimensions with respect to the desired workpiece's geometry.

In fact, earliest machined workpieces are rarely within the specifications (e.g. tolerances) given by the numerical model of the desired workpiece. This typically arises from a generation of machining instructions based on unprecise static and/or dynamic model of the grinding machine.

Some prior arts machining methods and grinding systems have addressed this problem by continuously monitoring circular portion of the workpiece during its manufacturing (e.g. on-process measurement).

However, this approach is not only time-consuming as systematically applied to each manufactured workpiece, but also requires a reduction of the diameter of the provided cylindrical material leading to an additional waste of time and of material.

Other prior arts machining methods and grinding systems have addressed the same problem by means of a calibration process, wherein a reference piece is machined along different directions so as to permit a correction of the model of the grinding machine that will be then used for machining a series of workpieces.

Although this approach permits to limit the waste of the time allocated for correcting the machine model during for a production of a series of identical workpieces, a use of target piece leads to an unwanted waste of time and material.

The applicant notices that non-conformities mostly arise from uncorrected position-dependent inaccuracies of the grinding machine and from workpieces being machined using unprecise wear-dependant dimensioning of the grinding wheel. The dimensioning of the grinding wheel 2 are notably (cf. FIG. 1):

- the radius 25 of (the circle 26 corresponding to) the curvature 24 of the grinding surface 21 of the abrasive wheel 2;
- the radius 22 of the abrasive wheel, i.e. the distance between the farthest distal points of the grinding surface 21 with respect to the rotational axis 20 (thereafter wheel rotational axis) around which the grinding wheel rotate, and the diameter 23 of the abrasive wheel, i.e. a distance between the farthest distal points of the grinding surface 21 crossing the wheel rotational axis 20);

the axial positioning (thereafter wheel axial positioning) of the abrasive wheel along the wheel rotational axis 20, notably of the line 27 perpendicular to rotational axis 20 and extending along the farthest axial portion 211 of the grinding surface 21 (with respect to the wheel rotational axis 20).

Figure 2B:
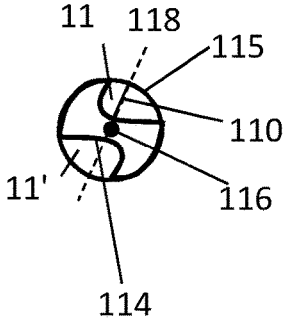

The proposed method for machining a workpiece comprising a desired helical groove relies, as illustrated in FIGS. 1-3, on:

grinding a calibration groove 12 on the surface 10 of the workpiece 1 according to the predetermined helix pattern 112, 113, 114 of the desired helical groove 11 and by means of the abrasive wheel 2 of the grinding machine 4;

determine a dimension 22, 23, 24, 25 of the abrasive wheel 2 (thereafter abrasive wheel dimension) by measuring a dimension 120 of the calibration groove; and use the determined dimension for grinding the desired helical groove 11 by means of the same abrasive wheel 2.

The calibration groove 12 has a length 121 (thereafter calibration length) that is equal or smaller than the predetermined length 111 of the desired helical groove 11. The calibration groove 12 has a depth 120 (thereafter calibration depth) that is smaller than the predetermined depth 110 of the desired helical groove 11. This configurations permit to later optically eliminate (i.e. remove) the calibration groove by machining the desired helical groove at the place of the calibration groove.

The abrasive wheel dimension is advantageously determined by measuring a surface of the groove, notably the calibration depth 120 of the calibration groove.

Advantageously, the proposed method further comprise a step of using the determined abrasive wheel dimension 22, 23, 24, 25 for grinding the desired helical groove 11 on a surface of another workpiece (or of a plurality of other workpieces) by means the abrasive wheel 2.

The proposed method is advantageously automatically implementable in the grinding machine, so as to execute the proposed machining of the workpiece by means of the grinding machine without any human intervention.

In particular, the proposed method can be implemented in the grinding machine so as the grinding machine is configured to execute (at least) the following steps without human aid:

the grinding of the calibration groove 12 on the workpiece;

the measure of the dimension 120 of the calibration groove;

the determination of the dimension 22, 23, 24, 25 of the abrasive wheel 2; and grinding the desired helical groove 11 by means of the same abrasive wheel 2 and by using the determined dimension, and eventually grinding of the desired helical groove on another workpiece.

The solution provides a method and a grinding machine for fabricating one workpiece of a series of identical workpieces, notably the first one, wherein the grinding of the desired helical groove on a surface of this workpiece permits to calibrate the grinding machine for machining the same workpiece as well as others successive workpieces of the series. As the workpiece is identical (e.g. within given tolerances) as the other of the series, there are no waste of time and row material. Moreover, the proposed method is automatically implementable in the grinding machine so as to further reduce the time required to machine the workpiece, as well as successive workpieces using the determined dimension.

The solution also reduces the total time required for calibrating the machine as the calibration procedure is part of the machining of one workpiece.

Moreover, the solution provides a more accurate calibration of the grinding machine. In fact, the abrasive wheel dimension is determined under the same grinding conditions for grinding the desired helical groove. This permits to take into consideration not the current dimensions of the abrasive wheel but also position-dependent inaccuracies of the grinding machine.

The proposed method provides thus a more reliable and cost-effective manufacturing of a series of identical elongated workpieces, each workpiece having the desired helical groove.

Figure 3A:
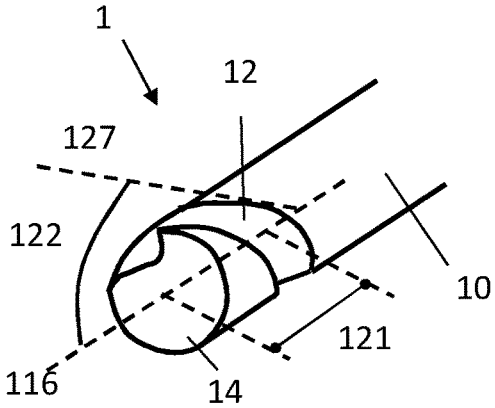
FIGS. 3*a-b* show an inclined and a cross-section view of the calibration groove on the workpiece of FIG. 1.
Figure 3B:
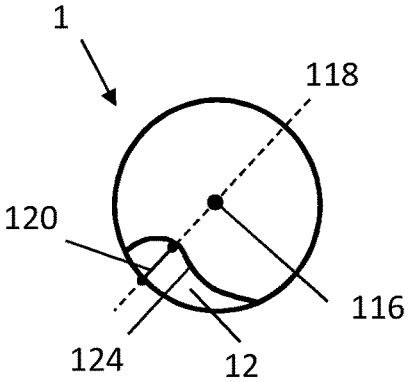

FIGS. 3*a-b* FIGS. 3*a-b* show details of a calibration groove machined on the workpiece 1 of FIG. 1, according to the invention.

The calibration groove 12 is obtained by machining the workpiece 1 (e.g. the cylindrical material to be machined), notably by:

rotating the abrasive wheel around the wheel rotational axis 20 being oriented along a predefined relative orientation with respect to the grinding rotational axis 30, and providing a relative positioning between the abrasive wheel and the workpiece, so as to grind the surface thereof.

Depending on the calibration length 121 of the calibration groove, the grinding of the calibration groove can also comprise:

provide a relative rotation 41 between the abrasive wheel and the workpiece around the grinding rotational axis 30, and provide a relative translation 42 between the abrasive wheel and the workpiece along the grinding rotational axis 30.

The predefined relative orientation is determined according to the predetermined helix pattern 112, 113, 114 of the desired helical groove.

In the illustrated embodiment of FIG. 1, the wheel rotational axis 20 is oriented so as his projection on the longitudinal axis of the workpiece (grinding rotational axis) is perpendicular to the helix orientation 117 so as to grind a calibration groove having a helix angle 122 corresponding to the helix angle 112 of the desired helical groove. In case the calibration groove comprises at least a complete turn, the ground calibration groove has a lead angle corresponding to the lead angle 113 of the desired helical groove.

Preferably, the grinding rotational axis 30 substantially corresponds to the longitudinal axis 116 of the workpiece so as to simplify the machining of the calibration groove and the desired helical groove on the surface 10 of the workpiece according to the predetermined helix pattern.

Once the calibration groove has been ground on the surface of the workpiece, a dimension of the calibration groove can be measured. The measurement can be carried out by means of a contact or contactless measuring instrument notably equipping the grinding machine, so as to determine a desired abrasive wheel dimension of the abrasive wheel.

In the illustrated embodiment, the desired dimension of the abrasive wheel is the diameter 23 and/or the radius 33 of the abrasive wheel.

This solution permits to initially determine as well as to update at regularly basis the value corresponding to the diameter 23 and/or the radius 33 of the abrasive wheel used to machine the current workpiece and successive ones so as to take care of variations notably due to use (e.g. wear) of the abrasive wheel.

The diameter 23 and the radius 33 of the abrasive wheel can be determined by measuring the calibration depth 120 of the calibration groove. In the illustrated embodiment, the calibration depth 120 is measured taking into account a relative positioning of the deepest surface of the calibration grove according to the measuring orientation 118.

The diameter 23 and the radius 33 of the abrasive wheel can be directly determined by knowing the relative positioning of the wheel rotational axis 20 and of the grinding rotational axis 30.

Alternatively or complementarily, the diameter 23 and the radius 33 can be indirectly determined by correcting an estimated value thereof by determining the difference between the measured calibration depth 120 and an expected calibration depth being estimated according to this estimated value.

Figure 4:
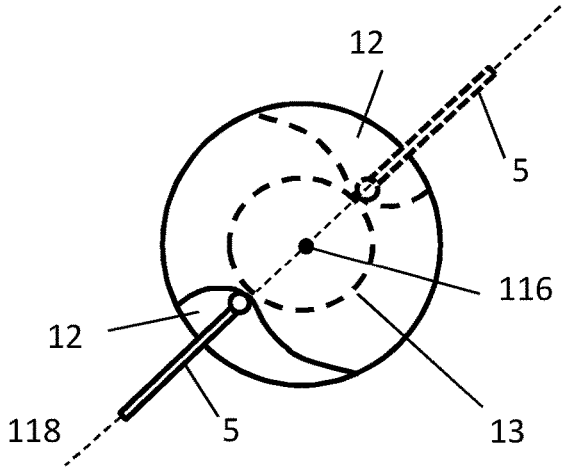
FIG. 4 schematically shows a measurement of a depth of a calibration groove on a workpiece by means of a touch probe.

In case the calibration groove comprises at least a complete half turn as illustrated in FIG. 4, the calibration depth 120 can thus be measured by determining the shortest radial distance between a pair of deepest points of the surface of the calibration groove, this from opposite directions along the same measuring orientation 118.

This radial distance corresponds to the diameter of an imaginary inner circle 13 built by projecting edges of the calibration groove on an imaginary a plane being perpendicular to the longitudinal axis 116 of the workpiece.

The diameter of the inner circle can be determined by:

- measuring a first deeper point along a selected measuring orientation 118 by means of a measuring instrument,
- rotating the workpiece about 180° around his longitudinal axis 116; and
- measuring a second deeper point along the same measuring orientation 118 by means of the same measuring instrument.

In case the workpiece comprise a second desired helical groove 11' having a second predetermined length, a second predetermined depth and a second predetermined helix pattern to be machined at the surface of the workpiece by means of the abrasive wheel of the grinding machine, the second deeper point can be a deeper point of a second calibration groove being ground on the surface of the same workpiece by means of the abrasive wheel. The second calibration groove has:

- a depth that is smaller than the second predetermined depth, preferably being identical to the calibration depth 120 (of the first calibration groove); and
- a length that is equal or smaller than the second predetermined length.

Once the desired dimension of the abrasive wheel dimension is determined, the determined abrasive wheel dimension can be used to grind the desired helical groove 11 on the same surface 10 of the same workpiece by means of the same abrasive wheel 2.

The desired helical groove 11 is thus ground on the surface 10 of the same workpiece having the calibration groove, notably on the surfaces of the calibration groove, this according to the predetermined length 111, the predetermined depth 110 and the predetermined helix pattern 112, 113, 114.

The ground of the desired helical groove 11 can notably comprise steps of:

- rotating the abrasive wheel around the wheel rotational axis 20, preferably the wheel rotational axis 20 being oriented along the same predefined relative orientation used to ground the calibration groove;
- providing a relative positioning between the abrasive wheel and the workpiece, notably with respect to the calibration groove;
- providing a relative translation between the workpiece and the abrasive wheel along the grinding rotational axis 30; and
- providing a relative rotation between the abrasive wheel and the workpiece around the grinding rotational axis 30.

The ground of the desired helical groove on the surface of the workpiece leads to a remove (i.e. a disappearance from the surface of the workpiece) of the calibration groove, as:

- the calibration length 121 of the calibration groove is equal or smaller than the predetermined length 111 of the desired helical groove 11,
- the calibration depth 120 of the calibration groove is smaller than the predetermined depth 110 of the desired helical groove 11; and as
- the calibration groove 12 has been ground on the surface 10 according to the same predetermined helix pattern 112, 113, 114 of the desired helical groove 11 and by means of the same abrasive wheel 2.

Figure 5A:
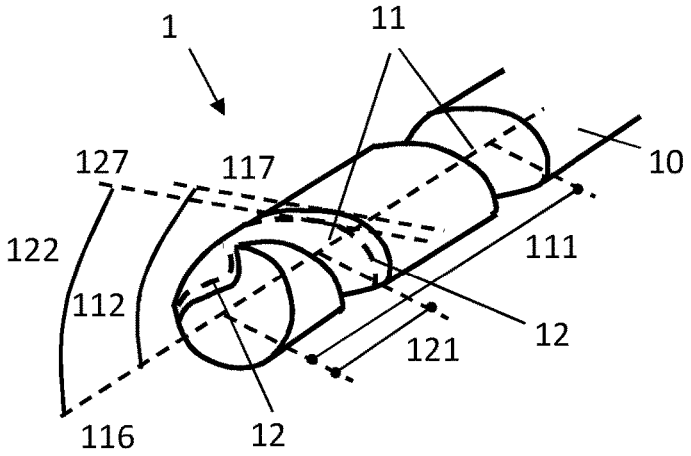
FIGS. 5*a-b* show an inclined and a cross-section of a helical groove machined on the surface of the workpiece illustrated in FIGS. 3*a,b;*
Figure 5B:
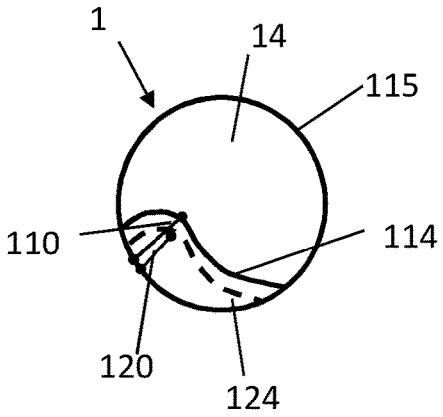

As schematically illustrated on FIGS. 5*a-b*, the grinding of the desired helical groove leads thus to a removal of the entire surfaces forming the calibration groove 12 (dashed lines in FIGS. 5*a-b*) from the machined surface 10 of the workpiece.

Figure 6A:
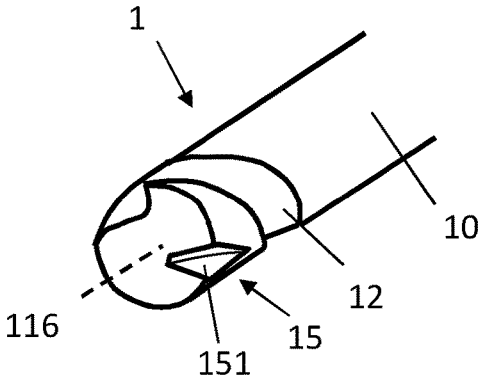
FIGS. 6*a-b* show an inclined and a cross-section view of the workpiece illustrated in FIGS. 3*a,b* with an additional calibration groove.
Figure 6B:
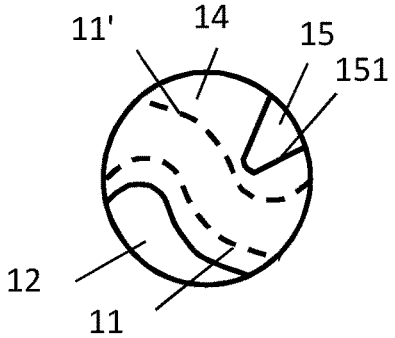

The determined abrasive wheel dimension can be also used to grind another (notably the second) desired helical groove 11' on the surface 10 of the same workpiece 1 by means of the same abrasive wheel 2 (cf. FIG. 6*b*).

The geometrical features of this other desired helical groove 11' (notably the length, the depth and the helix pattern) can be the same, identical or distinct with respect to the geometrical features of the desired helical groove 11.

Advantageously, the ground of this other desired helical groove 11' on the surface of the workpiece leads to a remove (i.e. a disappearance from the surface of the workpiece) of the second calibration groove being used to determine the inner circle of the workpiece.

The determined abrasive wheel dimension can then be used for grinding the desired helical groove on a surface of another workpiece by means the same abrasive wheel 2.

Actually, the proposed solution permits to use the determined abrasive wheel dimension for machining successive workpieces, notably of the same series of identical workpieces, without waste of material.

The proposed solution can also comprise a determination of another abrasive wheel dimension by means of a grinding of an additional calibration groove.

As illustrated in FIGS. 6*a-b*, the proposed solution can comprise:

- grinding an additional calibration groove 15 on a surface 10 of the workpiece 1 by the same abrasive wheel, and
- determine another abrasive wheel dimension (22, 23, 24, 25) of the abrasive wheel 2 by measuring a dimension of said additional calibration groove 15.

Preferably, said another abrasive wheel dimension is the wheel axial positioning 27 of the abrasive wheel.

The additional calibration groove 15 can thus be ground on a distal portion of the surface of workpiece, notably on the tip 14 of the workpiece 1.

The distal portion is selected so as at least the grounding of the calibration groove 12, the desired helical groove 11, or of the additional desired helical groove 11' will remove the additional calibration groove 15.

Alternatively or complementarily, in case the workpiece comprises a grinding of a chamfer, the distal portion can be selected so the grounding of this chamfer remove the additional calibration groove 15 from the surface of the machined workpiece.

The wheel axial positioning 27 can thus be determined by measuring the position of a surface 151 of the additional calibration groove 15 being ground by the farthest axial portion 211 of the grinding surface 21.

The additional calibration groove 15 can be ground before or after the grinding of the calibration groove 12.

The proposed solution also comprises a grinding machine for carrying out the proposed method, preferably without human aid.

The grinding machine 4 is schematically illustrated in FIG. 1.

The grinding machine 4 is configured to retain the workpiece 1, notably an extremity thereof, while the abrasive wheel 2 is rotational mounted on the grinding machine 4 so as to rotate around the wheel rotational axis 20.

The grinding machine 4 is advantageously configured to provide a movement between the abrasive wheel and the retained workpiece so as to permit a desired relative positioning between them.

In order to permit a grinding of the desired helical groove on the surface of the workpiece, the grinding machine 4 is configured to provide at least:

- a relatively rotation and a relative translation between the abrasive wheel and the retained workpiece around, and along respectively, the grinding rotational axis 30, and
- a relative movement between the abrasive wheel and the retained workpiece along the grinding translation axis 29.

Advantageously, the grinding machine 4 is configured to retain the workpiece so as its longitudinal axis 116, i.e. the symmetry axis of the cylindrical material to be machined, corresponds to the grinding rotational axis 30.

In the exemplary embodiment of FIG. 1, the grinding machine 4 is provided with a spindle 3 providing retention of an extremity of the workpiece 1 while providing a rotation of the workpiece around the grinding rotational axis 30 with respect to a base (not illustrated) of the grinding machine 4.

In this exemplary embodiment, the grinding machine 4 is also configured to move the abrasive wheel substantially in any position as well as to orientate the wheel rotating axis 20 substantially along any direction with respect to the surface 10 of workpiece 1, and notably with respect to the base. The relative movement can be provided by an articulated arm or badge-type structure providing a multiple degree of freedom for translation and for rotation.

The grinding machine is also configured to determine the abrasive wheel dimension of the abrasive wheel 2 by measuring a dimension, notably the calibration depth 120, of the calibration groove by means of a measuring instrument 5.

Complementarily, the grinding machine is also configured to determine another abrasive wheel dimension of the abrasive wheel 2 by measuring a dimension of the additional calibration groove 15. The dimension is advantageously the position of a surface 151 of the additional calibration groove 15 being ground by the farthest axial portion 211 of the grinding surface 21. Advantageously, the measure is accomplished by means of a measuring instrument 5.

The measuring instrument 5 can be a touch or a touchless instrument. Preferably, the measuring instrument 5 is data linked and/or controlled by the grinding machine, more preferably being part of the base equipping of the grinding machine.

This arrangement permits to measure dimensions of the workpiece, notably of the calibration groove, without to have to remove the workpiece from the grinding machine. This avoids grinding inaccuracies due to a non-identical repositioning of the workpiece in the machine for grinding the desired helical groove.

As previously described, the grinding machine is advantageously configured to execute the proposed method without human aid, notably (at least) the steps of:

- the grinding of the calibration groove 12 on the workpiece;
- the measure of the dimension 120 of the calibration groove;
- the determination of the dimension 22, 23, 24, 25 of the abrasive wheel 2;
- grinding the desired helical groove 11 by means of the same abrasive wheel 2 and by using the determined dimension, and more advantageously
- grinding of the desired helical groove on successive workpiece of the series of identical workpieces using the determined dimension.

The proposed solution also concern a software (with a set of grinding-machine executable instructions) for carrying out the proposed method on a grinding machine controlled by a processor (e.g. of the computer numerical control of the grinding machine) and having a measuring instrument 5 and a rotating abrasive wheel 6, wherein the grinding machine is capable (notably via the processor) to retain a workpiece 1 as well as to provide:

- a relative rotation between the workpiece 1 and the abrasive wheel 6 around a rotational axis 30 preferably coinciding with the longitudinal axis 116 of the workpiece 1; and/or
- a relative translation between the workpiece 1 and the abrasive wheel 6 along said rotational axis 30; and/or
- a relative movement between the workpiece 1 and the abrasive wheel 6.

A repetitive manufacturing of identical elongated workpieces, according to the proposed solution, can be realized by means of a program comprising a set of instructions configured, when executed on the processor controlling the grinding machine 4 to make the grinding machine 4 perform the steps of the proposed method.

The set of instructions can be advantageously configured so as to to control the grinding machine 4 to automatically perform the steps of the proposed method, i.e. without human aid.

The software is advantageously resident on a non-transitory storage medium that is connected or connectable to the processor so as to be readable by the processor.

Numbered Items

1 Workpiece
10 Surface of the workpiece
11, 11' Helical groove
110 Depth
111 Length

112 Helix angle
113 Lead angle
114 Cross sectional template
115 Circumference
116 Longitudinal axis
117 Tangent line
118 Measuring orientation
12 Calibration groove
120 Depth
121 Length
122 Helix angle
124 Cross sectional template
127 Tangent line
13 Inner circle
14 Free tip
15 Axial calibration groove
151 Calibration surface
2 Grinding wheel
20 Rotational axis
21 Grinding surface
22 Radius
23 Diameter
230, 231 Distal point of the grinding surface
24 Curvature of the grinding surface
25 Radius of the curvature
26 Circle of the curvature
27 Axial positioning
28 Grinding radial surface
29 Translation axis
3 Rotating spindle
30 Rotating axis
4 Grinding machine
41 Rotation
42 Translation
5 Touch probe

The invention claimed is:

1. A method for machining a workpiece by a grinding machine arranged for retaining the workpiece and comprising a rotating abrasive wheel; the workpiece comprising a desired helical groove having a predetermined length, a predetermined depth and a predetermined helix pattern to be machined at a surface of the workpiece by means of the abrasive wheel of the grinding machine;

the method comprising:

machining calibration groove on the surface according to said predetermined helix pattern and by means of the abrasive wheel; wherein the calibration groove has a calibration length that is equal to or smaller than the predetermined length of the desired helical groove and has a calibration depth that is smaller than the predetermined depth of the desired helical groove;

determine an abrasive wheel dimension of the abrasive wheel by measuring the calibration depth;

using said determined abrasive wheel dimension for machining the desired helical groove on said surface by means of said abrasive wheel.

2. The method according to claim 1, wherein the abrasive wheel dimension is a diameter or a radius of the abrasive wheel.

3. The method according to claim 1, wherein the predetermined helix pattern is a helix angle or a lead angle.

4. The method according to claim 1, wherein the calibration depth is measured without removing the workpiece from the grinding machine by means of a contact or contactless probe of the grinding machine.

5. The method according to claim 1, wherein said machining of the helical groove comprises:

rotating one of the workpiece and the abrasive wheel with respect to the other around a first rotational axis, the first rotational axis coinciding with a longitudinal axis of the workpiece;

translating one of the workpiece and the abrasive wheel with respect to the other along the first rotational axis; and rotating the abrasive wheel around a second rotational axis being oriented along a predefined relative orientation with respect to the first rotational axis.

6. The method according to claim 5, wherein said machining of the calibration groove comprises:

rotating the abrasive wheel around the second rotational axis being oriented along said predefined relative orientation used to grind the calibration groove.

7. The method according to claim 6, wherein said machining of the calibration groove also comprises:

rotating one of the workpiece and the abrasive wheel with respect to the other around the first rotational axis, and translating one of the workpiece and the abrasive wheel with respect to the other along the first rotational axis.

8. The method according to claim 1, the calibration depth being measured by determining a shortest radial distance between a pair of deepest points of the surface of the calibration groove around a longitudinal axis of the workpiece.

9. The method according to claim 1, further comprising a step of:

using the determined abrasive wheel dimension for grinding another desired helical groove on the surface of the workpiece by means the abrasive wheel.

10. The method according to claim 1, further comprising a step of:

using the determined abrasive wheel dimension for grinding the desired helical groove on a surface of another workpiece by means the abrasive wheel.

11. The method according to claim 1, further comprising a step of:

grinding an additional calibration groove on a distal portion of the surface of workpiece, and determine another abrasive wheel dimension of the abrasive wheel by measuring a relative positioning of a surface of said additional calibration groove, said another abrasive wheel dimension being a relative positioning of a radially extending wall of the abrasive wheel with respect to a rotational axis thereof.

12. The method according to claim 1, wherein the workpiece is a milling and/or drilling tool, a drill, an end mill or a rotary cutter.

13. A grinding machine for carrying out the method for machining a workpiece according to claim 1, the grinding machine comprising a measuring instrument and a rotating abrasive wheel;

the grinding machine being configured to retain a workpiece and to provide:

a relative rotation between the workpiece and the abrasive wheel around a rotational axis coinciding with a longitudinal axis of the workpiece; and/or a relative translation between the workpiece and the abrasive wheel along said rotational axis; and/or a relative movement between the workpiece and the abrasive wheel;

and wherein the grinding machine is also configured to:

grind the calibration groove by means of the abrasive wheel;

to determine the abrasive wheel dimension of the abrasive wheel by measuring the calibration depth by means of the measuring instrument;

to grind the desired helical groove by means of the abrasive wheel and by means of said determined abrasive wheel dimension.

14. The grinding machine according to claim 13, comprising a spindle arranged for retaining the workpiece;

the spindle being configured to:

rotate the workpiece around said rotational axis so as to provide said relative rotation between the workpiece and the abrasive wheel; and/or to translate the workpiece along said rotational axis so as to provide said relative translation between the workpiece and the abrasive wheel.

* * * * *